US008484911B2

(12) United States Patent
Zayas et al.

(10) Patent No.: US 8,484,911 B2
(45) Date of Patent: Jul. 16, 2013

(54) SLIDING PENDULUM SEISMIC ISOLATION SYSTEM

(75) Inventors: Victor Zayas, Sonoma, CA (US); Stanley Low, Oakland, CA (US)

(73) Assignee: Earthquake Protection Systems, Inc., Vallejo, CA (US)

( * ) Notice: Subject to any disclaimer, the term of this patent is extended or adjusted under 35 U.S.C. 154(b) by 57 days.

(21) Appl. No.: 11/383,147

(22) Filed: May 12, 2006

(65) Prior Publication Data

US 2006/0174555 A1 Aug. 10, 2006

(51) Int. Cl.
*E04B 1/98* (2006.01)
*E04H 9/02* (2006.01)

(52) U.S. Cl.
USPC ..... 52/167.5; 52/167.1; 248/562; 248/636

(58) Field of Classification Search
USPC ..... 52/167.4, 167.5, 167.8, 167.9, 167.1; 248/562, 636
See application file for complete search history.

(56) References Cited

U.S. PATENT DOCUMENTS 2,014,643 A * 9/1935 Bakker ..... 384/49
4,496,130 A * 1/1985 Toyama ..... 248/585
4,644,714 A 2/1987 Zayas
3,347,002 A 10/1987 Penkuhn
4,881,350 A * 11/1989 Wu ..... 52/167.5
5,689,919 A * 11/1997 Yano ..... 52/167.6
6,085,473 A * 7/2000 Teramachi et al. ..... 52/167.5
6,126,136 A 10/2000 Yen et al.
6,164,022 A * 12/2000 Ishikawa et al. ..... 52/167.5
6,321,492 B1 * 11/2001 Robinson ..... 52/167.1
6,505,806 B1 * 1/2003 Glaesener ..... 248/638
6,688,051 B2 * 2/2004 Tsai ..... 52/167.4
6,725,612 B2 * 4/2004 Kim ..... 52/167.5
6,820,380 B2 * 11/2004 Tsai ..... 52/167.4
6,862,849 B2 3/2005 Kim
6,951,083 B2 * 10/2005 Kim ..... 52/167.9
7,237,364 B2 * 7/2007 Tsai ..... 52/167.6
7,814,712 B2 * 10/2010 Tsai ..... 52/167.4

OTHER PUBLICATIONS

Victor A. Zayas, Stanley S. Low and Stephen A. Mahin; The FPS Earthquake Resisting System Experimental Report; Report No. UCB/EERC-87/01, Jun. 1987; University of California at Berkeley, College of Engineering; Berkeley, California, USA.

* cited by examiner

*Primary Examiner* — Joshua J Michener
*Assistant Examiner* — Chi Q Nguyen
(74) *Attorney, Agent, or Firm* — Oblon, Spivak, McClelland, Maier & Neustadt, L.L.P.

(57) ABSTRACT

An inventive method is presented for a sliding pendulum seismic isolation system that reduces seismic forces on the supported structure and reduces the costs of the isolation bearings, seismic gaps, and supported structural frame. The inventive method is to configure the isolation system to achieve increased effective friction with increased displacement amplitudes, and to employ specific bearing configurations that suit the different types and magnitudes of loads present at particular structure support locations. Three bearing configurations are presented which are comprised of multiple sliders that slide along different concave spherical surfaces, each constituting an independent sliding pendulum mechanism having a specified pendulum length and friction. Two bearing configurations are presented which are comprised of multiple sliders that slide along different concave or convex cylindrical surfaces, one configured to carry both compression and tension loads, and one configured to be cost-effective for carrying light compression loads and accommodating large displacements.

12 Claims, 7 Drawing Sheets

SLIDING PENDULUM SEISMIC ISOLATION SYSTEM

CROSS-REFERENCE TO RELATED APPLICATIONS

Not applicable.

STATEMENT REGARDING FEDERALLY SPONSERED RESEARCH AND DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Improvements are presented to the prior-art in the field of sliding pendulum seismic isolation systems.

The prior-art sliding pendulum bearings employ concave spherical or cylindrical surfaces, and sliders, which slide along these concave surfaces, resulting in a lifting of the supported structure during seismic ground motions. The lifting of the structure results in an equivalent pendulum motion. The radii of curvature of the concave surfaces result in an effective length of the pendulum arm, that determines the dynamic natural period of vibration of the isolation system. The friction, which occurs between the sliders and the concave surfaces, serves the important function of dissipating the energy associated with the seismic movements, that determines the effective friction and equivalent viscous damping of the isolation system.

A typical sliding pendulum seismic isolation system would employ three or more sliding pendulum bearings to support a structure and protect it from earthquake ground motions. The sliding pendulum mechanisms of these bearings are connected in parallel by the structure. For a pure horizontal displacement of the structure, the displacement occurring in each sliding pendulum mechanism is substantially equal to the displacement of the structure in that direction.

The prior-art spherical pendulum isolation systems are configured such that all sliders would slide in substantial unison during seismic movements, resulting in one effective pendulum length, and having one dynamic natural period of vibration based on pendulum type motion. The dynamic natural period of vibration of the isolation system (T) is equal to:

$$T=2\pi(L/g)^{1/2}$$

Where L is the effective pendulum length, g is the acceleration of gravity, and $\pi$ is equal to 3.1414.

The average friction occurring between the sliders and the concave surfaces determines the effective dynamic friction for the isolation system. The prior-art spherical bearings are configured such that the dynamic natural period and the effective friction is the same for sliding motion occurring in any horizontal direction. The prior-art spherical bearings are configured such that the effective friction is the same for different amplitudes of sliding motion.

The prior-art cylindrical pendulum systems operate similar to the spherical pendulum systems, except they have two independent sliding pendulum mechanisms operating in perpendicular directions. Each direction has a dynamic natural period according to the above equation. Each direction has an effective friction determined from the average friction of the sliders operating in that direction. Each direction has an effective friction that is the same for different amplitudes of sliding motion in that direction.

For both spherical and cylindrical sliding pendulum mechanisms, for lateral movements of the supported structure, the energy dissipated through friction in the bearings is in direct linear proportion to the total cumulative displacement travel of the supported structure. For one symmetrical cycle of movement of the supported structure, the energy dissipated per cycle ("EDC") is equal to:

$$EDC=4Wf_{eff}d$$

Where W is the weight of the supported structure, $f_{eff}$ is the effective friction of the isolation system, and d is the displacement amplitude away from, and back to center, in both the positive and negative directions. The EDC increases in direct proportion to increases in the displacement amplitude, d. The EDC also increases in direct proportion to increases in the effective friction. The EDC is used to calculate the equivalent viscous damping percentage, for cycles having a specified amplitude of lateral displacement. As the EDC increases, the equivalent viscous damping percentage increases.

In the typical seismic design of a structure supported by the prior-art systems, the strength of the structural frame would be designed to resist the seismic forces expected to occur during the design level earthquake. The effective pendulum length and effective friction of the bearings would be selected to achieve the target seismic forces during the design level earthquake. The design level earthquake is a strong earthquake having a reasonable probability of occurring once during the life of the structure. Lower strength service level earthquakes would be expected to occur more than once during the life of the structure. As compared to bearings designed specifically to minimize impacts from service level earthquakes, the prior-art bearings designed for the stronger design level earthquake would be considerably less effective at protecting contents and architectural components during service level earthquakes. Also, building codes typically require the bearings to accommodate the displacements that would occur during a maximum credible earthquake. These displacements are typically 50% to 100% larger than the design level earthquake displacements. Accommodating these larger displacements adds substantial cost to both the bearings and the structure seismic gaps.

The improvements to the prior-art sliding pendulum systems presented herein do not pertain to seismic isolation systems which employ rubber or steel springs as the primary means to achieve the desired isolation system period, nor to seismic isolation systems which employ fluid or viscous dampers as the primary means of dissipating the seismic motion energy, nor to energy dissipation devices that do not support a structure load, nor to sliding isolation systems which employ flat sliders and separate elements to provide the restoring force or damping, nor to negative pendulum systems which employ sliders sliding along convex surfaces resulting in a lowering of the supported structure, nor to isolation systems which employ roller bearings or rocker bearings to achieve equivalent pendulum motion, nor to sliding isolation systems which employ sliding mechanisms having sliders that for a substantive portion of their sliding distance slide along concave surfaces that are neither spherical nor cylindrical.

More that 95% of the prior-art patents for seismic bearings or supports have never been implemented in actual structures because of the high costs associated with their implementation. Although the majority of these prior-art bearings can be very effective at reducing seismic forces acting on the supported structures, if they are not cost-effective, they are never used. A major objective of the inventive method presented below is to achieve a cost-effective seismic isolation system.

BRIEF SUMMARY OF THE INVENTION

The invention claimed herein is a method of configuring sliding pendulum bearing components in such a manner that the seismic forces transmitted to the supported structure are reduced, and costs of the isolation bearings, seismic gaps, and supported structural frame are reduced, as compared to the prior-art systems. A primary concept of the method is to configure multiple independent sliding pendulum mechanisms connected in series, such that said independent mechanisms become active at different strengths of seismic motions, changing the effective pendulum length of the isolation system. Another primary concept of the method is to configure the isolation system in such a manner as to cause substantial increases in the effective friction of the isolation system when increases in the strength of the earthquake motions cause increases in the displacement amplitudes of the supported structure. Another primary concept is to have specific bearing configurations that are designed specifically to accommodate the different types and magnitudes of supported structure loads that occur at particular support points.

Various bearing configurations are presented herein that are used to implement the inventive method to construct a seismic isolation system suitable to buildings, bridges, industrial tanks, and industrial facilities. Selecting the appropriate bearing configuration can substantially reduce the structural frame costs for the protected structure. The preferred embodiment for implementing the inventive method is to use specific bearing configurations that have multiple independent sliding pendulum mechanisms, that provide increased effective friction at increased displacement amplitudes, and that are suited to the different support point requirements that occur at particular structure support points.

Three embodiments of bearing configurations employ two or more spherical sliding pendulums configured in series to become active or inactive at different strengths of earthquake motions. Two of these embodiments employ sliders that slide along concave spherical surfaces, where these concave surfaces have adjacent convex spherical surfaces that at stronger motions slide along another set of concave spherical surfaces. Another embodiment employs two opposing concave surfaces, each having sliders that slide along them, and the two sliders are connected together in a manner that allows the two sliders to support the load and slide and rotate as independent pendulum mechanisms. Another embodiment employs concave cylindrical surfaces, and opposing convex cylindrical surfaces, and sliders, which slide along these cylindrical surfaces. At lower strength earthquakes, the sliders slide only along the concave cylindrical surfaces. At stronger earthquake motions, the sliders begin to slide along the convex cylindrical surfaces causing the effective friction to progressively increase as the earthquake motions become stronger. These embodiments allow the different pendulum elements to be tuned to optimize the performance of the isolation system for service level, design level, and maximum credible earthquakes.

The above four bearing configurations are cost-effective to support high structure loads, and accommodate moderate or large seismic displacements. However, these bearing configurations are not cost-effective to support light loads, and accommodate large seismic displacements. To overcome this limitation, a bearing configuration is presented which is cost-effective when supporting light structure loads and accommodating large seismic displacements. This embodiment employs two opposing concave cylindrical surfaces, and sliders that slide along these cylindrical surfaces, and a means of connecting the two sliders that can support the load, and allow the sliders to rotate relative to each other, such that the sliders can operate as independent pendulums as they slide along the concave cylindrical surfaces.

By combining one or more of the configurations of sliding pendulum bearings presented herein, as appropriate at each particular support point of a structure, an isolation system is achieved that reduces the earthquake forces on the structure, reduces the displacements in the bearings, and reduces the costs of the isolation bearings, seismic gaps, and supported structural frame.

DETAILED DESCRIPTION OF THE INVENTION

In past applications of the prior-art sliding pendulum bearings to buildings, the authors have used between 12 to 267 seismic isolation bearings distributed throughout the structure at each support point. To implement the inventive method presented herein, different bearing configurations are required for different support conditions, depending on the type and magnitude of load to be supported, and the displacement capacity required. In combination, the multiple bearing supports implement a seismic isolation system following the inventive method prescribed herein. Six different bearing configurations for sliding pendulum bearings are presented to accommodate the varied conditions encountered in the applications of such a system to buildings, bridges and industrial facilities. No one bearing configuration presented herein is capable of meeting the objectives of the inventive method for the varied different support conditions encountered, for the various types of structures to be supported.

The preferred embodiment of the invention uses a combination of bearing configurations suited to the specific requirements of the particular support locations. For each structure support point, a bearing configuration is selected as appropriate to achieve lower seismic forces acting on the supported structure, and lower costs of the isolation system and structural frame of the supported structure. The structural materials and bearing liners used in the construction of these different bearing configurations are the same as those used in the prior-art bearings, only the configuration of the components are changed.

Figure 1:
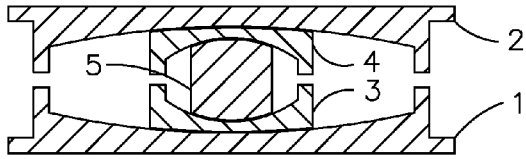
FIG. 1 Triple pendulum, spherical bearing, section A-A view.
Figure 2:
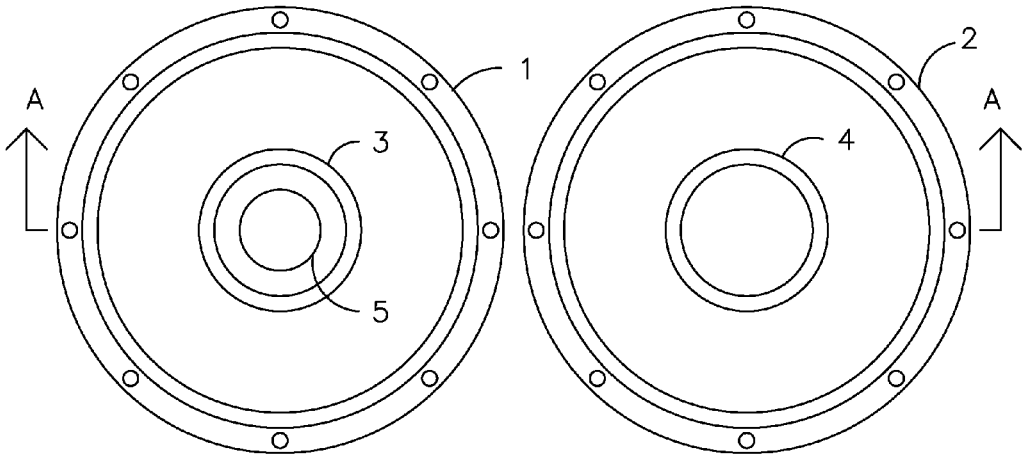
FIG. 2 Triple pendulum, spherical bearing, plan view of separated bearing components.

A cross-section view of the preferred bearing configuration, if suitable for the particular requirements of the structure support point, is shown in FIG. 1. A plan view of the bearing components is shown in FIG. 2. This triple pendulum bearing incorporates three distinct sliding pendulum mechanisms, connected in series to support the same structure load. When connected in series, a lateral displacement of the structure occurring at this support point will be distributed amongst one or more of the three pendulum mechanisms. The sum of the displacements occurring in the three mechanisms is equal to the total structure displacement at this support point.

The sliding pendulum mechanisms are connected in series in such a manner as to have the different mechanisms become active at different strengths of seismic motions. The simplest method to achieve this is to use different friction coefficients for the different mechanisms. In this manner, as each pendulum mechanism is activated, both the effective pendulum length and the effective friction increase as each mechanism is sequentially activated. Another method to have the different mechanisms become active at different strengths of seismic motions, is through the use of fusses such as break-away bolts. This approach would be used for an isolation system where low friction and damping is desired throughout the system response. In such a case, and using the same friction for each mechanism, as each mechanism became activated the effective pendulum length would increase, but the effective friction would remain the same.

For the bearing shown in FIG. 1, the effective length and effective friction of the three pendulum mechanisms can be selected independently, to provide optimum performance for three intensities of earthquake ground motions. This bearing configuration can provide optimized increases in effective friction at increased displacement amplitudes. This bearing configuration can provide optimized reductions in seismic forces acting on the supported structure. However, this bearing configuration is not economical for structure support points having light loads. Also, this bearing configuration is not economical for structure supports requiring only small displacement capacities.

As shown in FIG. 1, concave plate 1 has an upward facing concave spherical surface having a specified radius of curvature. Concave plate 2 has a downward facing concave spherical surface having its own specified radius of curvature. These concave plates can be constructed of a single material such as stainless steel, or may be constructed from steel or iron and have a coating on the concave surface of stainless steel or some other material that resists corrosion and facilitates sliding. The bolt holes shown around the perimeters of concave plates 1 and 2 are used to connect the bearing to the structure. Slider 3 has a convex surface that slides along concave plate 1, and also has a concave spherical surface having a radius smaller than the radius of concave plate 1. The convex surface of slider 3 would typically be surfaced with a bearing liner material providing a friction coefficient suitable for a design level earthquake. Slider 4 has a convex surface which slides along concave plate 2, and also has a concave spherical surface having a radius equal to the concave radius of slider 3. The convex surface of slider 4 would typically be surfaced with a bearing liner material providing a friction coefficient suitable for a maximum credible earthquake, typically two to three times the friction coefficient of slider 3. Slider 5 has convex spherical surfaces at the bottom and top that slide along the concave surfaces of sliders 3 and 4 respectively. The convex surfaces of slider 5 would typically be surfaced with a bearing liner material providing a friction coefficient typically one half to one third of the coefficient of slider 3. Sliders 3 and 4 would typically be joined together with an elastic seal around the perimeter, maintaining the components assembled and protecting the interior surfaces from contamination. Concaves 1 and 2 would typically be joined together with an elastic seal around the perimeter, protecting the interior surfaces from contamination, and configured to accommodate the large lateral deformations required during earthquake motions.

Figure 3:
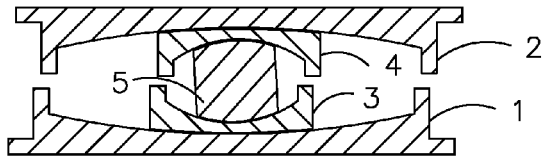
FIG. 3 Triple pendulum, spherical bearing, displaced position 1, section A-A view.
Figure 4:
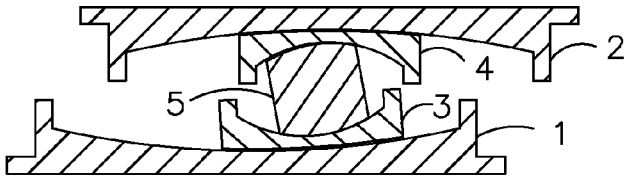
FIG. 4 Triple pendulum, spherical bearing, displaced position 2, section A-A view.
Figure 5:
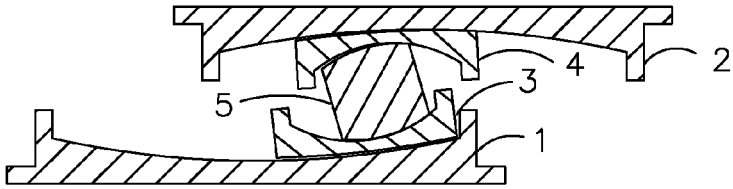
FIG. 5 Triple pendulum, spherical bearing, displaced position 3, section A-A view.
Figure 6:
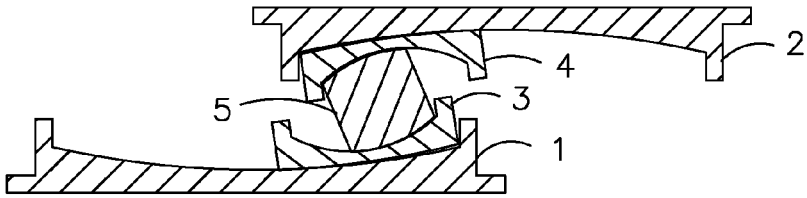
FIG. 6 Triple pendulum, spherical bearing, displaced position 4, section A-A view.

The bearing configuration shown in FIGS. 1 and 2 has the sliding pendulum motions as illustrated in FIGS. 3 to 6. FIG. 3 illustrates a pendulum mechanism where slider 3 translates horizontally relative to slider 4, but slider 3 has not moved relative to concaves 1, and slider 4 has not moved relative to concave 2. This motion constitutes a single sliding pendulum mechanism, P1. Slider 3 sliding along concave 1 is another sliding pendulum mechanism, P2, having an independently specified effective length and effective friction. Slider 4 sliding along concave 2 is another sliding pendulum mechanism, P3, having an independently specified effective length and effective friction.

In the P1 mechanism, for slider 3 to translate horizontally relative to slider 4, slider 5 must rotate and translate along the concave surfaces of sliders 3 and 4 (FIG. 3). This P1 motion constitutes a single sliding pendulum mechanism having an effective pendulum length equal to:

$$L1=2r_3-h$$

Where L1 is the effective pendulum length of mechanism P1, $r_3$ is the concave radius of sliders 3 and 4, and h is the height of component 5. The bearing liners of slider 5 control the friction, f1, of mechanism P1.

A critical function of sliders 3, 4, and 5 is that they are configured to allow the full articulation of slider 3 relative to slider 4, which is required to allow independent sliding and rotation of sliders 3 and 4 along concaves 1 and 2, respectively. A pure rotation of slider 3 relative to slider 4 is accommodated by a translation of slider 5.

To achieve very low sliding friction, the P1 mechanism and slider 5 liners can be lubricated with a silicone gel. This results in an essentially elastic P1 pendulum mechanism, having little to no energy dissipation through friction. A very low friction and essentially elastic inner pendulum mechanism minimizes high frequency vibrations transmitted to the supported structure. Reducing these high frequency vibrations can be of significance to sensitive equipment located within the supported structure.

The combination of the P1, P2 and P3 mechanisms in one bearing would typically result in four different effective pendulum lengths that become active at different displacement amplitudes. The four effective lengths for the complete bearing assembly are P1, P1+P2, P2+P3, and P3. The individual mechanism lengths are selected to obtain the effective pendulum lengths desired for the complete bearing at the different displacement amplitudes. The friction of each pendulum mechanism is selected to achieve the effective friction desired at the different displacement amplitudes.

Figure 7:
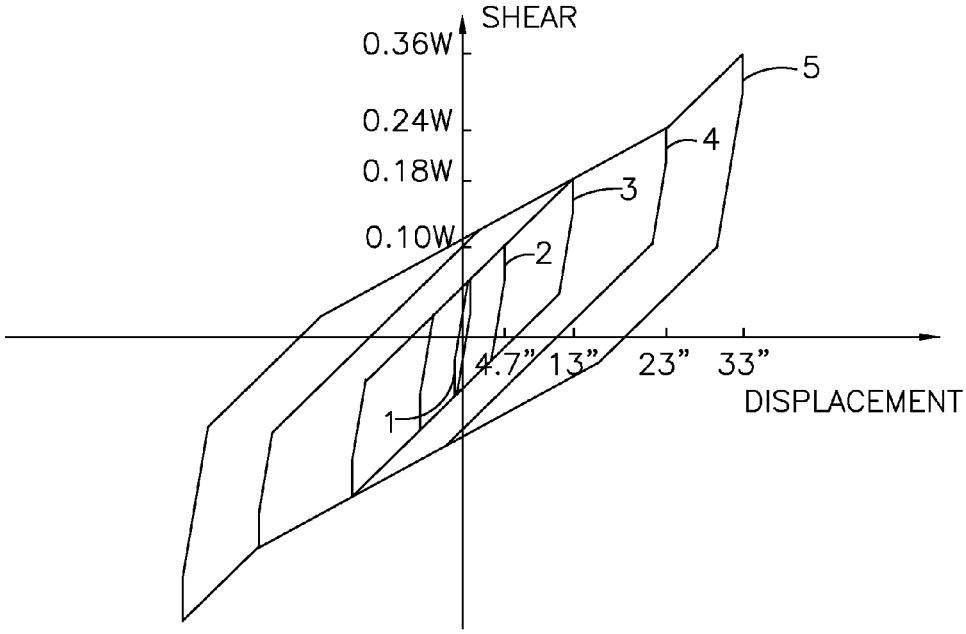
FIG. 7 Lateral force versus lateral displacement loops, triple pendulum, spherical bearing.

To illustrate how these three independent pendulum mechanisms combine to construct a bearing having increased effective friction at increased displacement amplitudes, an example is presented. A friction equal to 2% of the supported weight, an 18 inch effective pendulum length, and 5 inch horizontal displacement capacity are used for pendulum mechanism P1. A 6% friction, 84 inch effective length, and 15 inch horizontal displacement capacity are used for pendulum mechanism P2. An 18% friction, 84 inch effective length, and 15 inch horizontal displacement capacity are used for pendulum mechanism P3. These values would be suitable for the severe earthquake motions that would be expected to occur at a site near a major California earthquake fault. For a bearing having these three pendulum mechanisms, the force versus displacement relationship for symmetric positive and negative displacements are shown in FIG. 7. The effective friction for each loop is the weighted average of the friction of the different pendulum mechanisms in proportion to the displacement traveled in each mechanism.

For earthquake motions resulting in structure base shears less than 2% of the structure weight, there would be no pendulum motion in the bearing. Starting in a centered position, and increasing the lateral force from 0% to +6% results in a lateral displacement of +0.7 inches in mechanism P1. Continuing from the +0.7 inch position, and reducing and reversing the lateral force from +6%% to −6% results in a lateral displacement of −1.4 inches in mechanism P1, as shown in loop 1 of FIG. 7. Continuing from the −0.7 inch position, and increasing the lateral force from −6% to +6% results in a lateral displacement of +1.4 inches in mechanism P1, as shown in the continuation of loop 1, to complete a full cycle of lateral displacement movements. This loop is representative of the maximum forces and displacements that occur during common minor earthquakes.

Further increasing the lateral force from 6% to 10% results in an additional displacement of 0.7 inches in mechanism P1, and 3.3 inches in P2, as shown in loop 2. This is representative of the maximum force and displacement that occurs during a service level earthquake. Increasing the lateral force from 10% to 18% results in an additional displacement of 1.5 inches in mechanism P1, and 6.7 inches in P2, as shown in loop 3. The combined movements of mechanisms P1 and P2 result in an effective pendulum length equal to L1 plus L2. At a lateral force of 18%, the total displacement in the two mechanisms is 13 inches. This is representative of the maximum force and displacement that occurs during a design level earthquake. Increasing the lateral force from 18% to 24% results in an additional displacement of 5.0 inches in P2, and 5.0 inches in P3, having an effective pendulum length equal to L2 plus L3, as represented by loop 4. The combined movements of mechanisms P2 and P3 results in an effective pendulum length equal to L2 plus L3. At a lateral force of 24%, mechanism P2 has reached a total displacement of 15 inches, which is its displacement capacity limit. At a lateral force of 24% the total displacement in the three mechanisms is 23 inches. This is representative of the maximum force and displacement that occurs during a maximum credible earthquake, representative of typical California seismic zone 4 conditions. Increasing the lateral force from 24% to 36% results in an additional displacement of 10 inches in mechanism P3, having an effective pendulum length equal to L3, as represented by loop 5. At a lateral force of 36%, mechanism P3 has reached a total displacement of 15 inches, which is its displacement capacity limit. At a lateral force of 36%, the total displacement in the three mechanisms is 33 inches. This is representative of the maximum force and displacement that occurs for an extreme, near fault, maximum credible earthquake, representative of motions applicable to structures located directly next to major faults.

Loop 5 reaches a positive lateral force of 36%, at a positive lateral displacement of 33 inches. At this point, a reversal in displacement direction would result in reductions in the lateral force, as shown by the force-displacement loop. Reducing the lateral force to 32%, results in negative displacements occurring in mechanism P1. At a reduced lateral force of 24%, which occurs at a reduced displacement equal to 31 inches, negative displacements begin to occur in mechanism P2. At a reduced lateral force equal to zero (0%), which occurs at a reduced displacement of 11 inches, negative displacements begin to occur in mechanism P3.

It is important to note that when the displacement is increased from 23 inches to 33 inches, the sliding friction is 18%. Whereas, when the displacement is reduced from 33 inches to 23 inches, 2.5 inches of sliding occurs at a 2% friction, and 7.5 inches of sliding occurs at a 6% friction, resulting in a weighted average friction of 5%. Thus, the friction force that resists increases in displacements away from center is more than three times the friction force resisting displacements back to center. The higher friction forces serve to reduce the displacements away from center, and the lower friction forces facilitate re-centering of the bearing back to center. Acting together, these directional characteristics of the friction serve to reduce the displacements in the bearings, and the forces transmitted to the structure, and facilitate re-centering of the bearing.

For loop 1, all sliding occurs in mechanism P1, at a 2% friction. For loop 2, sliding occurs in mechanisms P1 and P2 at sliding frictions of 2% and 6%, resulting in an effective friction of 4.8%. For loop 3, sliding occurs in mechanisms P1 and P2 at sliding frictions of 2% and 6%, resulting in an effective friction of 5.1%. For loop 4, sliding occurs in mechanisms P1, P2 and P3 at sliding frictions of 2%, 6% and 18%, resulting in an effective friction of 8.1%. For loop 5, sliding occurs in mechanisms P1, P2 and P3 at sliding frictions of 2%, 6% and 18%, resulting in an effective friction of 11.3%. Thus, as the displacement amplitude of the loops increase, the effective friction increases, resulting in a system that provides more damping for stronger ground motions.

Consideration of loadings beyond those of the maximum credible earthquake are used to calculate the bearing's factor of safety for lateral loads and displacements, beyond those calculated for the maximum credible earthquake. Increasing the lateral force beyond 36%, to 48%, results in an additional displacement of 2 inches in mechanism P1, having an effective pendulum length equal to L1. At a lateral force of 48%, mechanism P1 has reached its total displacement capacity of 5 inches. At this lateral force, the three pendulum mechanisms have reached their displacement capacity limits. Further increase in lateral force beyond 48%, would be resisted by the retainer rings of mechanisms P1, P2, and P3.

A single pendulum bearing, designed following the prior-art methods, having an effective pendulum length of 168 inches, and a friction of 6%, was used in the design and analysis of isolation bearings for an essential building facility near a major fault in California. Non-linear time history dynamic analyses were used to calculate the maximum bearing displacements, structure base shear, and upper structure accelerations occurring during five different strength earthquakes. A triple pendulum bearing, very similar to the bearing shown in FIG. 1, having 2%, 6% and 18% sliding frictions, and pendulum mechanism radii of 18, 84 and 102 inches, were analyzed for the same five earthquake strengths. The results for both bearing types are summarized in Table 1 below.

TABLE 1

Dynamic Analysis Results

| Earthquake: 1992 Landers NS Earthquake Motion | Structure Response | Triple Pendulum Bearing | Single Pendulum Bearing |
|---|---|---|---|
| Minor Earthquake PGA = 0.09 g | Peak Bearing Displacement | 0.70 in. | 0.30 in. |
| | Structure Base Shear | 0.05 W | 0.06 W |
| | Peak In-Structure Acceleration | 0.17 g | 0.29 g |
| Service Level Earthquake PGA = 0.35 g | Peak Bearing Displacement | 4.7 in. | 4.7 in. |
| | Structure Base Shear | 0.10 W | 0.09 W |
| | Peak In-Structure Acceleration | 0.48 g | 0.65 g |
| Design Basis Earthquake PGA = 0.74 g | Peak Bearing Displacement | 13 in. | 17 in. |
| | Structure Base Shear | 0.18 W | 0.17 W |
| | Peak In-Structure Acceleration | 0.90 g | 1.1 g |
| Maximum Credible Earthquake PGA = 1.18 g | Peak Bearing Displacement | 24 in. | 38 in. |
| | Structure Base Shear | 0.24 W | 0.28 W |
| | Peak In-Structure Acceleration | 1.31 g | 1.58 g |
| Extreme Near Fault Earthquake PGA = 1.40 g | Peak Bearing Displacement | 33 in. | 49 in. |
| | Structure Base Shear | 0.32 W | 0.35 W |
| | Peak In-Structure Acceleration | 1.52 g | 1.76 g |

For the minor and service level earthquakes the triple pendulum bearing reduces in-structure accelerations by 41% and 26%, respectively, as compared to the single pendulum bearing. Base shears and displacements are similar. For the design level earthquake, bearing displacements are reduced by 24%, and base shears and in-structure accelerations are similar. For the maximum credible earthquake, bearing displacements are reduced by 37%, and base shears and in-structure accelerations are similar. The bearing providing this response, is very similar to the bearing shown in FIG. 1, and has a weight of 3600 lbs.

Figure 8:
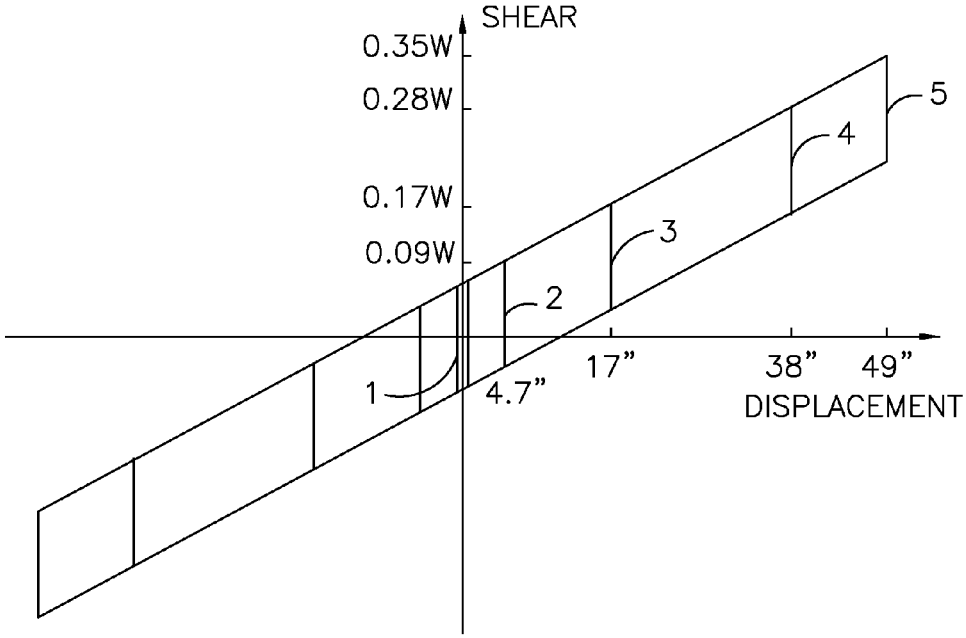
FIG. 8 PRIOR ART
FIG. 8 Prior-art, single pendulum bearing, lateral force versus lateral displacement loops.

The force displacement loops for the prior-art, single pendulum bearing, are shown in FIG. 8. The loops are drawn at the peak lateral forces and displacements calculated by the dynamic analysis for the five earthquake strengths. All loops in FIG. 8 for the prior-art bearing have an effective friction of 6%.

Figure 9:
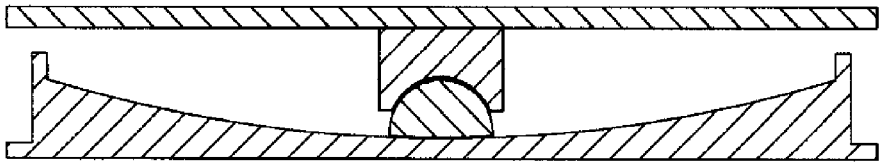
FIG. 9 PRIOR ART
FIG. 9 Prior-art, single pendulum bearing, section view.

The maximum displacement occurring in the bearing during the maximum credible earthquake is the primary factor that controls the size of the bearing. The single pendulum prior-art bearing, having the same load capacity as the FIG. 1 bearing, and having a pendulum length of 168 inches, and a friction of 6%, and displacement capacity of 51 inches, is shown in FIG. 9. The weight of this bearing is 24000 lbs. Bearings of this type and size, and larger, have been used in applications by the authors to accommodate severe maximum credible earthquake motions. The weight of the inventive method bearing, as shown in FIG. 1, is one-sixth of the weight of the prior-art bearing. The cost of the inventive method bearing, as shown in FIG. 1, is one-fourth of the cost of the prior-art bearing.

Figure 10:
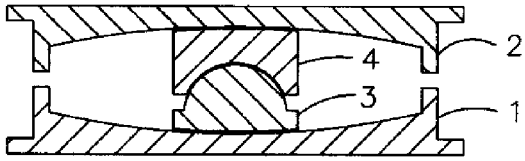
FIG. 10 Double pendulum, spherical bearing, section view.

A cross-section view of an alternate embodiment for a bearing configuration is shown in FIG. 10. This bearing configuration consists of two sliding pendulum mechanisms, connected in series, within the same load supporting bearing unit. The effective length and effective friction of the two pendulum mechanisms can be selected independently, to provide optimum performance for a design level earthquake and a maximum credible earthquake.

Concave plate 1 has an upward facing concave spherical surface having a specified radius of curvature. Concave plate 2 has a downward facing concave spherical surface having its own specified radius of curvature. These concave plates can be constructed of a single material such as stainless steel, or may be constructed from steel or iron and have a coating on the concave surface of stainless steel or some other material that resists corrosion and facilitates sliding. Slider 3 has a convex surface that slides along concave plate 1, and also has a convex spherical surface having a substantially smaller radius than the radius of concave plate 1. The larger radius convex surface of slider 3 would typically be surfaced with a bearing liner material providing a friction coefficient suitable for a design level earthquake. Slider 4 has a convex surface that slides along concave plate 2, and also has a concave spherical surface having a radius equal to the smaller radius convex surface of slider 3. The convex surface of slider 4 would typically be surfaced with a bearing liner material providing a friction coefficient suitable for a maximum credible earthquake, typically two to three times the friction coefficient of slider 3. The smaller radius convex surface of slider 3, together with the concave surface of slider 4, are capable of accommodating the full rotation of slider 3 relative to slider 4, such that each of the two sliders can operate as independent pendulums. The concave surface of slider 4 would typically be surfaced with a bearing liner material to facilitate articulation of slider 3 relative to slider 4. Concaves 1 and 2 would typically be joined together with an elastic seal around the perimeter, protecting the interior surfaces from contamination, and configured to accommodate the large lateral deformations required during earthquake motions. The double pendulum bearing shown in FIG. 10 can be less expensive to manufacture than the triple pendulum bearing shown in FIG. 1.

Figure 11:
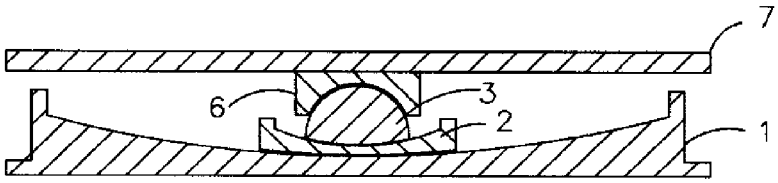
FIG. 11 Concentric support, double pendulum, spherical bearing, section view.

A cross-section view of a concentric support, double pendulum bearing following the inventive method is shown in FIG. 11. This bearing configuration consists of two sliding pendulum mechanisms, connected in series, within the same load supporting bearing unit. The effective length and effective friction of the two pendulum mechanisms can be selected independently, to provide optimal performance for a service level earthquake and a design level earthquake.

Concave plate 1 has a specified radius of curvature, and can be installed with the concave spherical surface facing upward or downward. Slider 2 has a convex surface that slides along concave plate 1, and also has a concave spherical surface having a substantially smaller radius than the radius of concave plate 1. The convex surface of slider 2 would typically be surfaced with a bearing liner material providing a friction coefficient suitable for a design level earthquake. Slider 3 has a convex surface that slides along slider 2, and has another convex spherical surface with a substantially smaller radius. Housing 6 has a concave surface with a radius equal to the smaller convex radius of slider 3. The smaller radius convex surface of slider 3, together with the concave surface of housing 6, are capable of accommodating the full rotation of slider 3 relative to slider 2, and the full rotation of slider 2 relative to concave 1, such that each of the two sliders can operate as independent pendulums. The concave surface of housing 6 would typically be surfaced with a bearing liner material to facilitate articulation of slider 3. Slider 3 and housing 6 would typically be joined together with an elastic seal around the perimeter, maintaining the components assembled and protecting the interior surfaces from contamination. Concave 1 and housing plate 7 would typically be joined together with a perimeter seal protecting the interior surfaces from contamination.

The double pendulum bearing shown in FIG. 11 maintains a fixed location of the support point relative to the portion of the structure connected to housing plate 7. This reduces the moments resulting from a moving support for which the portion of the structure connected to housing plate 7 needs to be designed. This can substantially reduce the structure costs when such a moment reduction is required because of structural frame limitations at this support point.

For the three spherical bearing configurations shown in FIGS. 1, 10 and 11, additional pendulum mechanisms can be obtained by adding additional elements having convex and concave surfaces similar to sliders 3 and 4 of FIG. 1. Having two additional such sliders, the FIG. 1 bearing would then have five independent pendulum mechanisms. Having two additional such sliders, the FIG. 10 bearing would then have four independent pendulum mechanisms. Having one additional such slider, the FIG. 11 bearing would then have three independent pendulum mechanisms.

For the three spherical bearing configurations shown in FIGS. 1, 10 and 11, it is typically advantageous to have both low and high friction sliders within the same bearing. Using standard prior-art bearing liners, an inventive means is presented for achieving low or very low friction in the applicable sliders. The radius of the convex spherical surface for the low friction sliders is made 20% or more larger than the radius of the concave spherical surface on which they slide. This achieves pressures around the perimeter of the slider that are much higher than the pressures that would occur if the radii were substantially equal. The standard bearing liners have friction coefficients that are significantly lower at much higher pressures. The difference in pressure resulting from the larger slider radius can be sufficient to achieve the low friction. The larger radius for the slider also leaves a gap between the central portion of the slider and the concave surface. When very low frictions are desired, a silicone gel lubricant is placed in this gap. The high perimeter pressures contain the gel lubricant in the central portion of the slider, and the movement of the slider across the concave surface lubricates the concave surface achieving very low frictions. Using this technique for the FIG. 1 bearing configuration, a very low friction of 0.5%, a low friction of 5%, and a high friction of 10% can be obtained using the same bearing liner material for the three pendulum mechanisms.

Figure 12:
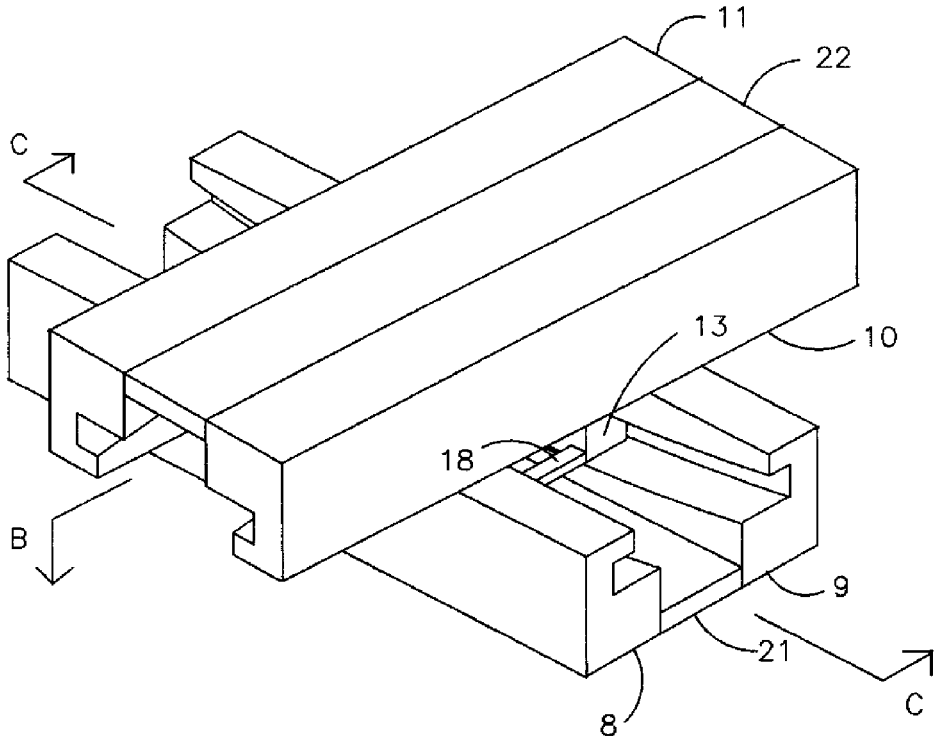
FIG. 12 Bi-directional, cylindrical pendulum bearing, tension capable, isometric view.

An isometric view of a double pendulum cylindrical bearing is shown in FIG. 12. This bearing configuration consists of two sliding pendulum mechanisms, orthogonal to each other, within the same load supporting bearing unit. The effective length and effective friction of the two pendulum mechanisms can be selected independently, to provide optimum performance for a service level earthquake and a design level earthquake.

Figure 13:
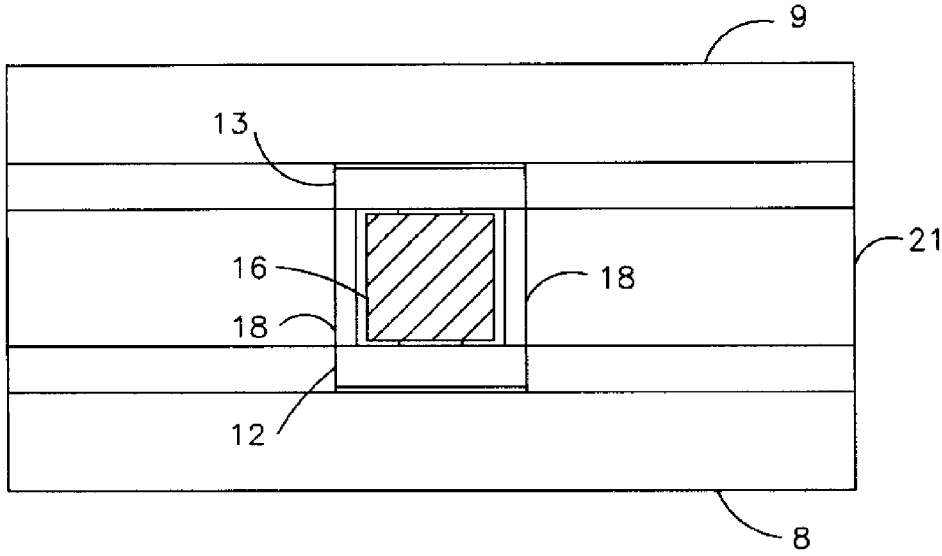
FIG. 13 Bi-directional, cylindrical pendulum bearing, tension capable, horizontal plane Section B-B view showing lower bearing components.
Figure 14:
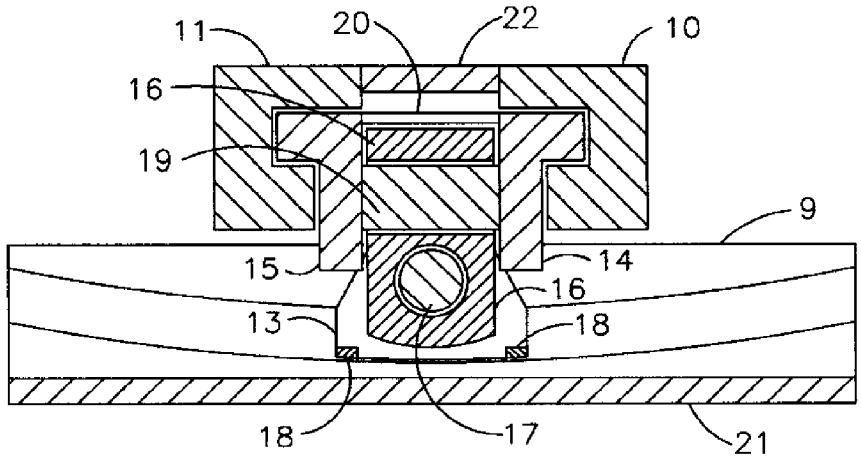
FIG. 14 Bi-directional, cylindrical pendulum bearing, tension capable, vertical plane cross Section C-C view.

This is an embodiment of a bearing configuration following the inventive method which is capable of carrying tension loads as well as compression loads. A plan view of the lower rails and housing is shown in FIG. 13. A section view of the complete bearing is shown in FIG. 14.

The concave surfaces of rail 8 and rail 9 are parallel and spaced apart, with the distance in-between the concave surfaces not less than 30% of the height of the bearing assembly. This separation is needed to effectively resist shear loads and overturning moments occurring orthogonal to rails 8 and 9. Rail 8 and 9 have upward facing concave cylindrical surfaces having a specified and equal radius, and also have downward facing convex surfaces having a specified and equal radius smaller than the concave radius. Rail 10 and rail 11 are similar to rails 8 and 9 and are oriented perpendicular to rails 8 and 9. The concave surfaces of rail 10 and rail 11 are parallel and spaced apart, with the distance in-between the concave surfaces not less than 30% of the height of the bearing assembly. This separation is needed to effectively resist shear loads and overturning moments occurring orthogonal to rails 10 and 11. Rail 10 and rail 11 have downward facing concave cylindrical surfaces having a specified and equal radius, and also have upward facing convex surfaces having a specified and equal radius smaller than the concave radius. Sliders 12 and 13 slide along rails 8 and 9, in-between the concave and convex surfaces of rails 8 and 9. Sliders 12 and 13 have bearing liners on the convex sliding surface having a specified coefficient of friction for compression sliding, and have bearing liners on the concave sliding surface having a specified coefficient of friction for tension sliding. Sliders 14 and 15 slide along rails 10 and 11, in-between the concave and convex surfaces of rails 10 and 11. Sliders 14 and 15 have bearing liners on the convex sliding surface having a specified coefficient of friction for compression sliding, and have bearing liners on the concave sliding surface having a specified coefficient of friction for sliding in tension. Housing 16 is an assembly configured to carry the structure loads and transfer these loads to sliders 12, 13, 14 and 15. Housing 16 has a cylindrical pin 17 which transfers the structure load to slider 12 and 13 while allowing the sliders to rotate relative to housing 16 as the sliders slide along rails 8 and 9. Two tie braces 18 prevent the sliding surfaces of slider 12 to separate from the sliding surfaces of slider 13. Housing 16 has a cylindrical pin 19 which transfers the structure load to slider 14 and 15 while allowing the sliders to rotate relative to housing 16 as the sliders slide along rails 10 and 11. Two tie braces 20 which prevent the sliding surfaces of slider 14 to separate from the sliding surfaces of slider 15. Element 16 maintains the relative position of rails 8 and 9, and is used to connect the bearing to the lower structure. Rails 8 and 9 and element 16 can be made as one integral part, made from one continuous structural material, with added surfacing materials as required. Alternatively, rails 8 and 9 and element 14 can be separate components joined together. Element 22 maintains the relative position of rails 10 and 11, and is used to connect the bearing to the upper structure. Rails 10 and 11 and element 22 can also be made of one integral structural material, or can be separate components joined together.

Rails 8 and 9, with sliders 12 and 13, are the primary components of pendulum mechanism P1, having a specified effective pendulum length, and specified compression friction, and specified tension friction. Rails 10 and 11, with sliders 14 and 15, are the primary components of pendulum mechanism P2, having a specified effective pendulum length, and specified compression friction, and specified tension friction.

The primary advantage of this cylindrical pendulum bearing is that it can carry tension loads as well as compression loads. In a building structure subjected to seismic ground motions, tension forces would typically develop at the support points under the shear walls or braced frame bents. The prior-art, and the embodiments presented above, typically are not capable of carrying these tension loads. Because of this limitation, in the past the structural systems have been reconfigured to avoid these tension forces, which typically adds substantial cost to the structural frame of the supported structure.

The FIG. 12 bearing configuration provides increased effective friction at increased displacement amplitudes, and the ability to carry tension loads. The two pendulum mechanisms in the two directions have the same characteristics. To illustrate how this pendulum mechanism operates, an example is presented for displacements occurring along one of these directions. A 3% compression friction, and 12% tension friction, and 156 inch effective length are used for pendulum mechanisms P1 and P2. Two separate bearings having these same properties are assumed to be supporting a shear wall in a building. The center of mass providing vertical load on these two bearings is assumed to be at a vertical height above the bearings that is ten times the horizontal distance between the bearings. For ground motions resulting in base shears less than 3% there is no pendulum motion in the bearings. For motions resulting in shears from 3% to 10% sliding occurs only in compression on the concave surfaces, at a sliding friction of 3%. At a shear of 10%, the displacement is equal to 11 inches. At shears greater than 10%, tension forces begin to occur in one of the bearings and equal increases in compression forces occur in the other bearing. The added tension and compression loads increase in proportion to the increases in displacement. At a structure shear equal to 30%, and a displacement equal to 30 inches, the added tension and compression loads are equal to twice the supported weight. These added vertical loads increase the friction force to 18% of the supported weight. For increases in displacement from 11 inches to 30 inches, the sliding friction increases from 3% to 18%. This increase in sliding friction in proportion to increased displacements, results in an increase in the effective friction for cycles with increased displacement amplitudes.

The components shown in FIG. 13, used without the other components shown in FIGS. 12 and 14, can be used as a unidirectional sliding pendulum bearing. This bearing is simply a one directional version of the bi-directional bearing shown in FIG. 12, having the same characteristics described above for the FIG. 12 bearing. Unidirectional bearings capable of carrying tension loads are advantageous in applications to certain types of bridge structures. The use of only those components shown in FIG. 13, constitutes another embodiment of the inventive bearing configurations.

The above embodiments are cost-effective seismic isolation bearings when supporting high structure loads and accommodating large seismic displacements. However, these embodiments are not cost-effective when supporting light loads and accommodating large seismic displacements.

Figure 15:
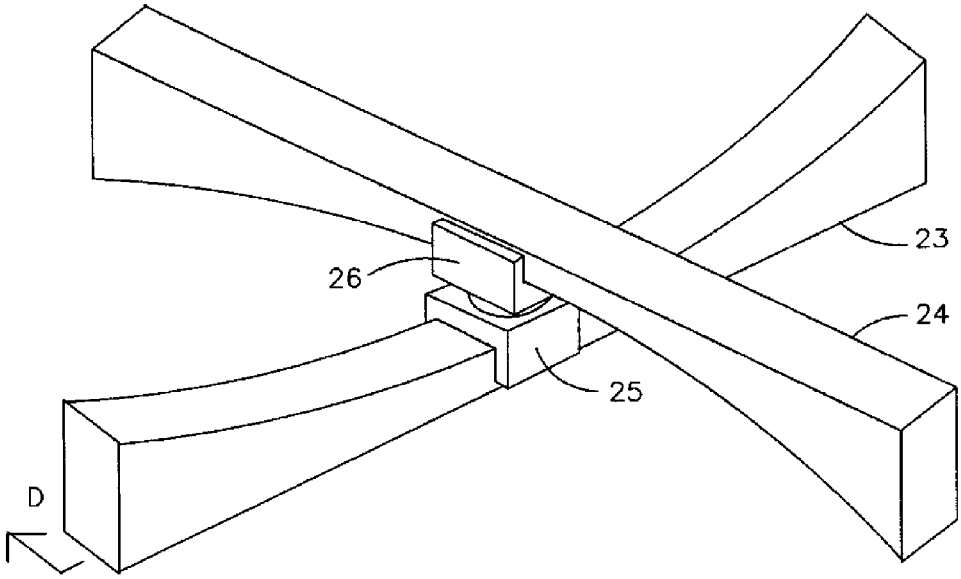
FIG. 15 Bi-directional, cylindrical pendulum bearing, compression only, isometric view.
Figure 16:
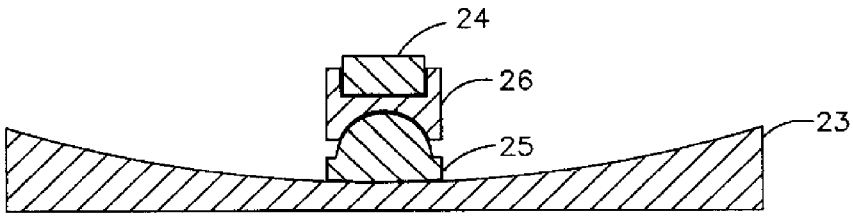
FIG. 16 Bi-directional, cylindrical pendulum bearing, compression only, section D-D view.

An isometric view of a double pendulum cylindrical bearing following the inventive method is shown in FIG. 15. A section view of the bearing is shown in FIG. 16. This bearing configuration consists of two sliding pendulum mechanisms, orthogonal to each other, within the same load supporting bearing unit. This bearing is cost-effective for supporting light compression loads and accommodating large displacements, but cannot resist tension loads. A displacement stop would typically be placed at the ends of the cylindrical concave surfaces such that the sliders could not slide off the ends of the rails. Also, flanges with holes for attachment bolts would typically be added along the long straight edge of the rail, to allow connection of the rails to the structure. For clarity, the displacement stops and bolt flanges are not shown in the drawings.

Rail 23 has an upward facing cylindrical surface having a specified radius. Rail 24 has a downward facing cylindrical surface having a specified radius that can be different than or the same as the concave radius for rail 23. Rail 24 is oriented perpendicular to rail 23. Slider 25 has a convex cylindrical surface that slides along the concave surface of rail 23, and two side guides that slide along the sides of rail 23. Slider 26 has a convex cylindrical surface that slides along the concave surface of rail 24, and two side guides that slide along the sides of rail 24. Slider 25 has a convex spherical surface of specified radius smaller than the concave radius of rail 23. Slider 26 has a concave spherical surface having substantially the same radius as the convex spherical surface of slider 25. The convex spherical surface of slider 25 and the concave surface of slider 26 are configured to carry the full structure load and allow full articulation of slider 25 relative to slider 26, such that sliders 25 and 26 can operate as independent pendulum mechanisms. The convex cylindrical surface of slider 25 has a bearing liner having a specified coefficient of friction applicable for compression sliding. The two side guides of slider 25 have a bearing liner having a specified coefficient of friction applicable to the side sliding of the guides against the rail which occurs under the transverse loads perpendicular to the direction of sliding. The convex cylindrical surface of slider 26 has a bearing liner having a specified coefficient of friction applicable for compression sliding. The two side guides of slider 26 have a bearing liner having a specified coefficient of friction applicable to the side sliding under the transverse loads perpendicular to the side of rail 24. Two guide pins are located at the two corners of each side guide of each slider. The guide pins run along in an oversized cylindrical groove in the side of the rail. The eight guide pins are used to maintain connectivity of the two sliders with the two rails, during combined uplift and lateral displacements. An elastic seal which joins together the perimeter of sliders 25 and 26 is used to maintain connectivity of the two sliders during combined uplift and lateral displacements. Modest uplift displacements are accommodated through stretching of the seal. This prevents disengagement of sliders 25 and 26 during an uplift displacement. The guide pins and elastic seal do not affect the sliding properties of the bearing, and are not shown in the drawings for clarity.

When slider 26 slides along rail 24, lateral loads are transmitted to slider 25 which are perpendicular to the direction of sliding for slider 25. The larger the displacement of slider 26, the larger the perpendicular load is on slider 25. When slider 25 slides along rail 23, lateral loads are transmitted to slider 26 which are perpendicular to the direction of sliding for slider 26. The larger the displacement of slider 25, the larger the perpendicular load is on slider 26. The total sliding friction for sliders 25 and 26 is the combined friction from the compression loads, and the side sliding friction from the perpendicular lateral loads. The total sliding friction value for slider 25 increases as the result of increases in the displacement of slider 26. The total sliding friction value for slider 26 increases as the result of increases in the displacement of slider 25. Therefore, for cycles of loading having increased amplitudes of displacement, the effective friction for sliders 25 and 26 increases. This increase in effective friction for sliders 25 and 26, as the lateral displacements are increased, results in an increase in the effective friction of the isolation system for cycles with increased displacement amplitudes.

Most of the prior-art sliding pendulum systems operate similar to or equivalent to bearings having the FIG. 9 configuration. All of the five main embodiments of bearing configurations presented herein offer different important advantages as compared to the prior-art bearings. The FIG. 1 bearing configuration can be optimized for three levels of earthquakes, and can provide the maximum increases in effective friction with increases in displacement amplitudes. This FIG. 1 configuration is cost-effective for medium to high supported loads, and medium to large lateral displacements. The FIG. 10 bearing configuration can be optimized for two levels of earthquakes, is cost-effective for medium to high supported loads and medium to large lateral displacements, and is somewhat less costly to manufacture than the FIG. 1 bearing. The FIG. 11 bearing configuration can be optimized for two levels of earthquakes, and maintains a concentric support point for the structure connected to the housing element, which can save substantial costs in construction of the structural frame of the supported structure. The FIG. 12 bearing configuration can be optimized for two directions of earthquake motion, and carries tension loads, which can save substantial costs in the construction of the supported structural frame. The FIG. 15 bearing configuration can be optimized for two directions of earthquake motion, and is cost-effective for light supported loads, and medium to large lateral displacements.

Following the inventive method presented herein, through the combination of one or more of the inventive bearing configurations as appropriate for the type of structure and specific support location requirements, a seismic isolation system is achieved that is optimized for different levels of earthquakes, reduces the lateral displacements required, and substantially reduces the cost of the isolation bearings, seismic gaps, and supported structural frame.

What is claimed is:

1. In a sliding pendulum seismic isolation system for protecting a structure from earthquake ground motions, said isolation system having concave spherical surfaces and sliders that support the structure, and where said sliders slide along said concave spherical surfaces resulting in a lifting of the supported structure consistent with a specified effective pendulum length, wherein the improvement comprises:

a configuration of two or more independent sliding pendulum mechanisms configured so as to function consecutively in series for lateral displacements in the same direction, at least one of said pendulum mechanisms having a specified friction coefficient that is lower than the specified friction coefficient of another of said sliding pendulum mechanisms, said independent sliding pendulum mechanisms configured to become consecutively active or inactive in series at increasing amplitudes of lateral displacement in the same direction, and said independent pendulum mechanisms configured such that the effective pendulum length of the isolation system in the direction of motion changes when the sliding pendulum mechanisms become active or inactive.

2. The sliding pendulum seismic isolation bearing according to claim 1, constructed such that the friction coefficient of one of said sliding pendulum mechanisms is less than half of the friction coefficient of another of said sliding pendulum mechanisms.

3. In a sliding pendulum seismic isolation system for protecting a structure from earthquake ground motions, said isolation system having concave spherical surfaces and sliders that support the structure, and where said sliders slide along said concave spherical surfaces resulting in a lifting of the supported structure consistent with a specified effective pendulum length, wherein the improvement comprises:

a configuration of two or more independent sliding pendulum mechanisms configured to function consecutively in series such that said pendulum mechanisms become active or inactive at increasing amplitudes of lateral displacement in the same direction, at least one of said pendulum mechanisms having a specified friction coefficient that is lower than the specified friction coefficient of another of said sliding pendulum mechanisms, and said sliders configured to achieve increases in the effective friction of the isolation system as the amplitudes of the displacement are increased in the direction of motion.

4. A sliding pendulum seismic isolation bearing having concave spherical surfaces that support a structure load, and sliders that slide along said concave spherical surfaces in any horizontal direction, wherein the improvement comprises a configuration of elements that includes:

a first concave element having an upward facing concave spherical surface with a specified radius of curvature, a second concave element having a downward facing concave spherical surface with a specified radius of curvature, a first slider having a convex spherical surface that slides along the concave surface of said first concave element, and having an opposing concave spherical surface having a radius substantially smaller than the radius of the concave surface of said first concave element, a second slider having a convex spherical surface that slides along the concave surface of said second concave element, and having an opposing concave spherical surface having a radius substantially equal to the radius of the concave surface of said first slider element, and a third slider having a lower convex spherical surface that slides along the concave surface of said first slider element, and having an upper convex spherical surface that slides along the concave surface of said second slider, and where the sliding motion of said third slider is configured to result in a sliding pendulum mechanism having a specified effective pendulum length, and where the sliding motion of said third slider can accommodate a lateral displacement of said first slider relative to said second slider without requiring any relative rotation of said first slider relative to said second slider.

5. The sliding pendulum seismic isolation bearing according to claim 4, where said first and second sliders are connected together by a perimeter elastic membrane which maintains the said first, second and third sliders connected together during seismic movements, and prevents said second and third sliders from separating when said second concave element lifts up and away from said second slider.

6. A sliding pendulum seismic isolation bearing having concave spherical surfaces that support a structure load, and sliders that slide along said concave spherical surfaces in any horizontal direction, wherein the improvement comprises a configuration of elements that includes:

a first concave element having an upward facing concave spherical surface with a specified radius of curvature, a second concave element having a downward facing concave spherical surface with a specified radius of curvature, a first slider having a convex spherical surface that slides along the concave surface of said first concave element, and having an opposing concave spherical surface having a radius substantially smaller than the radius of the concave surface of said first concave element, a second slider having a convex spherical surface that slides along the concave surface of said second concave element, and having an opposing convex spherical surface having a radius substantially equal to the radius of the concave surface of said first slider element, and where said opposing convex spherical surface of said second slider, and said opposing concave spherical surface of said first slider, are configured to allow said first slider to reach the edge of said concave surface of said first concave element while said second slider remains at the center of said concave surface of said second concave element, and where said opposing convex spherical surface of said second slider, and said opposing concave spherical surface of said first slider, are configured to allow said second slider to reach the edge of said concave surface of said second concave element while said first slider remains at the center of said concave surface of said first concave element.

7. A sliding pendulum seismic isolation bearing having concave spherical surfaces that support a structure load, and sliders that slide along said concave spherical surfaces in any horizontal direction, wherein the improvement comprises a configuration of such elements that includes:

a concave element having an upward or downward facing concave spherical surface with a specified radius of curvature, a first slider having a convex spherical surface that slides along the concave surface of said concave element, and having an opposing concave spherical surface having a radius smaller than the radius of the concave surface of said concave element, a second slider having a convex spherical surface that slides along the concave surface of said first slider, and having an opposing convex spherical surface having a radius substantially smaller than the radius of the concave surface of said first slider element, and a housing element having a concave spherical surface having a radius substantially equal to the radius of the smaller radius convex surface of said second slider, where said concave surface of said housing is configured to allow said second slider and said first slider to articulate while sliding along the concave surfaces.

8. A sliding pendulum seismic isolation bearing having concave cylindrical surfaces that support a structure load, and sliders that slide along said concave cylindrical surfaces, wherein the improvement comprises a configuration of such elements that includes:

a first rail element having a concave cylindrical surface facing upward or downward and having a convex cylindrical surface facing in an orientation opposed to said concave cylindrical surface of said first rail, a second rail element parallel to said first rail and spaced some horizontal distance from said first rail, said second rail having a concave cylindrical surface facing in the same orientation as the concave surface of said first rail, and having a convex cylindrical surface facing in an orientation opposed to said concave cylindrical surface of said second rail, a first slider having a convex surface that slides along the concave surface of said first rail, and having a concave surface that slides along the convex surface of said first rail, a second slider having a convex surface that slides along the concave surface of said second rail, and having a concave surface that slides along the convex surface of said second rail, a housing element that transfers the structure loads to said first and second sliders, and that facilitates rotation of said first and second sliders relative to said housing.

9. The sliding pendulum seismic isolation bearing according to claim 8, having additional elements that support a structure load, and where said additional elements are comprised of:

a third rail element spaced some vertical distance from said first and second rails, and said third rail having a horizontal orientation which is perpendicular to the horizontal orientation of said first and second rails, and having a concave cylindrical surface facing in an orientation opposed to the concave surfaces of said first and second rails, and having a convex cylindrical surface facing in an orientation opposed to said concave surface of said third rail, a fourth rail element parallel to said third rail and spaced some horizontal distance from said third rail, and said fourth rail having a concave cylindrical surface facing in the same orientation as the concave surface of said third rail, and having a convex cylindrical surface facing in an orientation opposed to said concave surface of said fourth rail, a third slider having a convex surface that slides along the concave surface of said third rail, and having a concave surface that slides along the convex surface of said third rail, a fourth slider having a convex surface that slides along the concave surface of said fourth rail, and having a concave surface that slides along the convex surface of said fourth rail, and where said housing element also transfers the structure loads to said third and fourth sliders, and facilitates rotation of said third and fourth sliders relative to said housing.

10. The sliding pendulum seismic isolation bearing according to claim 8, where the concave surfaces of the slider elements are surfaced with a bearing liner that provides significantly higher friction than the bearing liners on the convex surfaces of said slider elements.

11. The sliding pendulum seismic isolation bearing according to claim 8, where the first and second sliders are connected together by a cylindrical pin passing through the housing element, said pin transferring structure loads to said first and second sliders.

12. The sliding pendulum seismic isolation bearing according to claim 8, where the first and second sliders are connected together by brace elements which maintain the sliding surfaces of said first slider at a relatively fixed distance from the sliding surfaces of said second slider.

* * * * *